US010584705B2

(12) United States Patent
Niu et al.

(10) Patent No.: US 10,584,705 B2
(45) Date of Patent: Mar. 10, 2020

(54) CENTRIFUGAL PUMP AND METHOD FOR MANUFACTURING THE SAME

(71) Applicant: Hangzhou Sanhua Research Institute Co., Ltd., Hangzhou, Zhejiang (CN)

(72) Inventors: Lianjing Niu, Zhejiang (CN); Rongrong Zhang, Zhejiang (CN); Junfeng Bao, Zhejiang (CN); Junchao Zhang, Zhejiang (CN); Jun Zhang, Zhejiang (CN)

(73) Assignee: Zhejiang Sanhua Automotive Components Co., Ltd., Hangzhou, Zhejiang (CN)

( * ) Notice: Subject to any disclaimer, the term of this patent is extended or adjusted under 35 U.S.C. 154(b) by 514 days.

(21) Appl. No.: 15/140,277

(22) Filed: Apr. 27, 2016

(65) Prior Publication Data

US 2016/0319822 A1 Nov. 3, 2016

(30) Foreign Application Priority Data

Apr. 30, 2015 (CN) ..... 2015 1 0216842
Apr. 30, 2015 (CN) ..... 2015 1 0219764

(51) Int. Cl.
*F04D 13/06* (2006.01)
*F04D 25/06* (2006.01)
(Continued)

(52) U.S. Cl.
CPC ..... *F04D 25/06* (2013.01); *F04D 1/00* (2013.01); *F04D 17/10* (2013.01); *F04D 29/026* (2013.01);
(Continued)

(58) Field of Classification Search
CPC ..... F04D 29/2216; F04D 25/064; F04D 13/0606; F04D 13/0673; F05D 2240/307; F05D 2240/301; F05D 2240/30
See application file for complete search history.

(56) References Cited

U.S. PATENT DOCUMENTS 1,062,006 A * 5/1913 Hessling ..... F04D 29/281 416/178
2,712,412 A * 7/1955 West ..... F04D 23/003 406/57
(Continued)

FOREIGN PATENT DOCUMENTS

CN 2059687 U 7/1990
CN 1338576 A 3/2002
(Continued)

OTHER PUBLICATIONS

By Design, Part design 107: Draft angles, by Beall, published 2000; URL: https://www.plasticstoday.com/injection-molding/design-part-design-107-draft-angles/8979129051490.*
(Continued)

*Primary Examiner* — Charles G Freay
*Assistant Examiner* — Thomas Fink
(74) *Attorney, Agent, or Firm* — Wolf, Greenfield & Sacks, P.C.

(57) ABSTRACT

A centrifugal pump is provided, which includes a rotor assembly, the rotor assembly includes an impeller including multiple blades and a blade fixing portion, the blades and the blade fixing portion are integrally formed by injection molding, and the blades are circumferentially distributed at equal intervals along the blade fixing portion. The blade includes a first side, a second side, a blade top portion and a blade root portion, and the blade root portion and the blade fixing portion are fixed by injection molding. The blade top portion is a cantilever end of the blade, and the first side and
(Continued)

the second side are arranged between the blade root portion and the blade top portion. The rotor assembly arranged in such manner can improve the hydraulic efficiency and lift of the centrifugal pump.

7 Claims, 5 Drawing Sheets

(51) Int. Cl.

| | |
|---|---|
| ***F04D 29/22*** | (2006.01) |
| ***F04D 1/00*** | (2006.01) |
| ***F04D 29/24*** | (2006.01) |
| ***F04D 29/02*** | (2006.01) |
| ***F04D 17/10*** | (2006.01) |
| ***F04D 29/62*** | (2006.01) |
| *F04D 29/20* | (2006.01) |

(52) U.S. Cl.
CPC ..... *F04D 29/2216* (2013.01); *F04D 29/2222* (2013.01); *F04D 29/242* (2013.01); *F04D 29/624* (2013.01); *F04D 13/0673* (2013.01); *F04D 29/20* (2013.01); *F05D 2240/301* (2013.01); *F05D 2240/305* (2013.01); *F05D 2240/306* (2013.01)

(56) References Cited

U.S. PATENT DOCUMENTS 3,964,840 A * 6/1976 Kamelmacher ..... F04D 29/24 416/183
6,524,083 B2 * 2/2003 Deai ..... F04D 13/064 417/370
6,805,531 B2 * 10/2004 Iida ..... B29C 45/0062 415/206
D532,903 S * 11/2006 Hirata ..... D23/413
7,241,114 B2 * 7/2007 Koeppler ..... F04D 29/242 416/186 R
2010/0096112 A1 * 4/2010 Zha ..... F04D 29/281 165/121
2010/0239417 A1 * 9/2010 Scott ..... F04D 7/04 415/203
2010/0242280 A1 * 9/2010 Adachi ..... B29C 65/08 29/889.7
2010/0284812 A1 11/2010 Zandeh
2014/0079558 A1 * 3/2014 Koivikko ..... F04D 29/24 416/223 R
2014/0127029 A1 * 5/2014 Yang ..... F04D 29/281 416/223 B
2015/0165397 A1 * 6/2015 Higbee ..... B01F 7/00275 366/343
2015/0240818 A1 * 8/2015 Haddad ..... F04D 7/04 415/206
2017/0268526 A1 * 9/2017 Seok ..... F04D 29/2216
2017/0306971 A1 * 10/2017 Yamashita ..... F04D 25/02
2018/0216468 A1 * 8/2018 Gaibor ..... F04C 19/00

FOREIGN PATENT DOCUMENTS

| | | | |
|---|---|---|---|
| CN | 203570663 | U | 4/2014 |
| DE | 10133936 | A1 | 1/2003 |
| EP | 2236835 | A1 | 10/2010 |
| EP | 2273123 | A1 | 1/2012 |
| WO | WO 2015/000677 | A1 | 1/2015 |

OTHER PUBLICATIONS

Extended European Search Report, dated Sep. 14, 2016, from European Application No. 16167218.3.
Office Communication for Application No. EP 16 167 218.3 dated Feb. 21, 2018.
First Office Action for Chinese Application No. 201510219764.4, dated Nov. 13, 2018.
Second Office Action for Chinese Application No. 201510216842.5, dated Apr. 1, 2019.
Second Office Action for Chinese Application No. 201510219764.4, dated Apr. 1, 2019.
Wei et al., Light chemical machinery. China Light Industry Press. May 31, 1994, p. 142, paragraph 4.

* cited by examiner

CENTRIFUGAL PUMP AND METHOD FOR MANUFACTURING THE SAME

CROSS REFERENCE OF RELATED APPLICATION

The present application claims the priorities to Chinese Patent Applications No. 201510219764.4, titled "CENTRIFUGAL PUMP", filed on Apr. 30, 2015, and No. 201510216842.5, titled "METHOD FOR MANUFACTURING CENTRIFUGAL PUMP", filed on Apr. 30, 2015, with the State Intellectual Property Office of the People's Republic of China, the contents of which are incorporated herein by reference in their entireties.

FIELD

The present application relates to the technical field of automobiles, and particularly to component and part of the automobile.

BACKGROUND

Currently, requirements raised by the automobile industry to centrifugal pumps develop in the trend of miniaturization and high energy efficiency. In design of a centrifugal pump, the design of an impeller is critical for improving of the pump performance. In conventional designs, the centrifugal pump has a small overall size, and correspondingly, the impeller also has a small diameter, the impeller includes blades, the blades are circular-arc type, in such a case, the blades can hardly meet the requirements for a high lift and a high hydraulic efficiency of the centrifugal pump with a low specific speed and a small flow rate.

Therefore, it is necessary to improve the conventional technology, to address the above technical issues.

SUMMARY

An object of the present application is to provide a centrifugal pump, and a method for manufacturing the centrifugal pump, to allow the provided centrifugal pump to meet the requirements of minimization and lightweight.

To achieve the above objects, the following technical solutions are adopted in the present application: a centrifugal pump is provided, which includes a rotor assembly and a shaft, the rotor assembly is rotatable about the shaft or rotatable together with the shaft, the rotor assembly includes an impeller, and the impeller is rotatable about the shaft or rotatable together with the shaft.

The impeller includes blades and a blade fixing portion, the blades are uniformly distributed in a circumferential direction of the blade fixing portion, the impeller defines a hypothetical cylinder surface taking a central shaft of the blade fixing portion as a center line, intersections defined by the blades intersecting with the hypothetical cylinder surface are distributed at equal intervals in a circumferential direction of the hypothetical cylinder surface.

Each of the blades includes a first side, a second side, a blade top portion and a blade root portion, the blade root portion and the blade fixing portion are formed by injection molding or fixed by injection molding, the blade top portion is a free end of each of the blades, the first side and the second side are located between the blade root portion and the blade top portion, each of the first side and the second side includes a convex portion and a concave portion, and the convex portion and the concave portion are smoothly connected.

A blade cross section is defined by cutting each of the blades via the hypothetical cylinder surface, the blade cross section includes a first intersecting line, a second intersecting line, a third intersecting line and a fourth intersecting line, wherein the first intersecting line is an intersecting line defined by the hypothetical cylinder surface intersecting with the first side, the second intersecting line is an intersecting line defined by the hypothetical cylinder surface intersecting with the second side, the third intersecting line is an intersecting line defined by the hypothetical cylinder surface intersecting with the blade top portion, and the fourth intersecting line is an intersecting line defined by the hypothetical cylinder surface intersecting with the blade root portion, and a middle line is a straight line passing through a middle point of the third intersecting line and parallel to the central shaft of the impeller.

A height of the blade in the blade cross section is defined as a distance from the fourth intersecting line to, an intersection between, the first intersecting line or the second intersecting line, and a line parallel to the fourth intersecting line, in the blade cross section at a portion with a first height H1, a distance from the first intersecting line to the middle line is a first distance L1, and a distance from the second intersecting line to the middle line is a second distance L2, and at a portion with a second height H2, a distance from the first intersecting line to the middle line is a third distance L1', and a distance from the second intersecting line to the middle line is a fourth distance L2', the following relationship is satisfied: in the case that the first height H1 is greater than the second height H2, the first distance L1 is less than or equal to the third distance L1', and the second distance L2 is less than or equal to the fourth distance L2'.

A method for manufacturing a centrifugal pump is further provided according to the present application, the centrifugal pump includes a rotor assembly, the rotor assembly includes an injection molded body and a shaft sleeve, the injection molded body includes an impeller, the impeller includes blades and a blade fixing portion. The manufacturing of the rotor assembly includes the following steps:

fixing the shaft sleeve to a rotor assembly mould, wherein the rotor assembly mould is configured to form the injection molded body of the rotor assembly, and the shaft sleeve includes a shaft sleeve inner cavity, the rotor assembly mould formed an molded cavity, a fixing shaft is fixed in the molded cavity, wherein the step of fixing the shaft sleeve to the rotor assembly mould includes: sleeving the shaft sleeve on the fixing shaft;

forming the injection molded body of the rotor assembly by injection molding, including: injection molding a filled material into the molded cavity of the rotor assembly mould, ensuring that the mixed material is filled into the inner cavity of the mould, and cooling and solidifying the injection molded body of the rotor assembly; and demolding, including: a combined the injection molded body and the shaft sleeve stripping from the rotor assembly mould, where:

the injection molded body includes an impeller, the impeller includes blades and a blade fixing portion, the blades and the blade fixing portion are fixed by injection molding, each of the blades includes a first side, a second side, a connection side and a blade top portion, and the first side and the second side are connected by the connection side and the blade top portion;

the first side includes a first convex portion and a first concave portion, the first convex portion and the first concave portion are connected smoothly, the second side includes a second convex portion and a second concave portion, and the second convex portion and the second concave portion are connected smoothly; and an outer surface of a hypothetical cylinder taking a central shaft of the impeller as an axis hypothetically cuts the blade to define a blade cross section, and a plane perpendicular to the central shaft of the impeller is arranged to be perpendicular to the blade cross section;

an outer surface of a hypothetical cylinder taking a central shaft of the impeller as an axis hypothetically cuts the blade to define a blade cross section, and a plane perpendicular to the central shaft of the impeller is arranged to be perpendicular to the blade cross section; and a blade cross section is defined by cutting each of the blades via the hypothetical cylinder surface, the blade cross section includes a first intersecting line, a second intersecting line, a third intersecting line and a fourth intersecting line, wherein the first intersecting line is an intersecting line defined by the hypothetical cylinder surface intersecting with the first side, the second intersecting line is an intersecting line defined by the hypothetical cylinder surface intersecting with the second side, the third intersecting line is an intersecting line defined by the hypothetical cylinder surface intersecting with the blade top portion, and the fourth intersecting line is an intersecting line defined by the hypothetical cylinder surface intersecting with the blade root portion, and a middle line is a straight line passing through a middle point of the third intersecting line and parallel to the central shaft of the impeller. A height of the blade in the blade cross section is defined as a distance from the fourth intersecting line to, an intersection between, the first intersecting line or the second intersecting line, and a line parallel to the fourth intersecting line, in the blade cross section at a portion with a first height H1, a distance from the first intersecting line to the middle line is a first distance L1, and a distance from the second intersecting line to the middle line is a second distance L2, and at a portion with a second height H2, a distance from the first intersecting line to the middle line is a third distance L1', and a distance from the second intersecting line to the middle line is a fourth distance L2', the following relationship is satisfied: in the case that the first height H1 is greater than the second height H2, the first distance L1 is less than or equal to the third distance L1', and the second distance L2 is less than or equal to the fourth distance L2'.

Compared with the conventional technology, the centrifugal pump according to the present application includes the impeller, and the blade includes a first side and a second side, the first side and the second side each includes a convex portion and a concave portion, and the convex portion and the concave portion are connected by a smooth transition, the blades in such shape may improve both a dynamic pressure and a static pressure, and thus may improve the hydraulic efficiency and lift of the centrifugal pump. a hypothetical cylinder surface taking a central shaft of the blade fixing portion as a center line cuts the blade to define a blade cross section, and on the blade cross section, in the case that the first height H1 is greater than the second height H2, the first distance L1 is smaller or equal to the third distance L1', and the second distance L2 is smaller than or equal to the fourth distance L2', thus the blade is not provided with a twisting structure, and the mould stripping during manufacturing is easily performed.

DETAILED DESCRIPTION

The present application is further described in conjunction with drawings and embodiments hereinafter.

Generally, centrifugal pumps include mechanical centrifugal pump and electrically driven centrifugal pump. The mechanical centrifugal pump drives an impeller to rotate by mechanical movements; and the electrically driven centrifugal pump includes a rotor having magnetism, and the rotor drives the impeller to rotate. A centrifugal pump according to the present application is mainly used in the automobile field, components in the automobile field are developing in the trend of intellectualization and precision, and the electrically driven centrifugal pump can better meet the requirements of the automobile field. The present application is specifically described taking the electrically driven centrifugal pump, which is abbreviated as an electrically driven pump, as an example.

Figure 1:
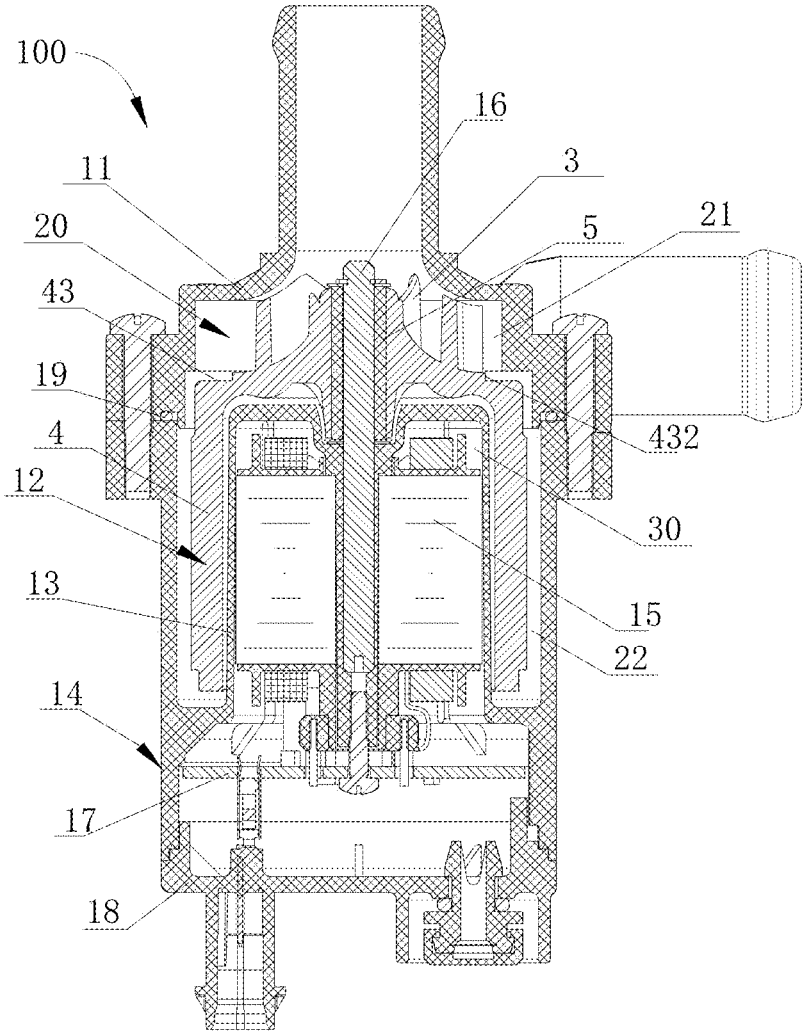
FIG. 1 is a sectional schematic view showing the structure of an embodiment of a centrifugal pump according to the present application.

FIG. 1 is a schematic view showing the structure of an electrically driven pump 100. The electrically driven pump 100 includes a first housing 11, a second housing 14, a rotor assembly 12, a stator assembly 15, a shaft 16, a printed circuit board 17, and an end cover 18. An inner cavity includes a space between the first housing 11 and the second housing 14, and between the second housing 14 and the end cover 18. The first housing 11 is fixedly connected to the second housing 14, and a portion where the first housing 11 and the second housing 14 are connected is provided with a sealing ring 19. The electrically driven pump 100 is provided with an partition 13, and the inner cavity is divided by the partition 13 into a wet chamber 20 and an dry chamber 30. The wet chamber 20 may allow a working medium to flow through, and the rotor assembly 12 is arranged in the wet chamber 20. There is no working medium flowing through the dry chamber 30, and the stator assembly 15 and the printed circuit board 17 are arranged in the dry chamber 30. The stator assembly 15 is electrically connected to the printed circuit board 17 via leads, and the printed circuit board 17 is connected to an external circuit. In this embodiment, the partition 13 and the second housing 14 are an integrally injection molded part, and the integrally injection molded part including the second housing 14 and the partition 13 is injection molded taking the shaft 16 as an injection molding insert. In this embodiment, the electrically driven pump 100 is an outer rotor type electrically driven pump, and the outer rotor type electrically driven pump is referred to as a pump in which the shaft 16 is taken as a central shaft, and a rotor 4 of the rotor assembly 12 is located at an outer periphery of the stator assembly 15, i.e., the stator assembly 15 is arranged to be closer to the shaft 16 than the rotor 4.

As shown in FIG. 1, the rotor assembly 12 is arranged in the wet chamber 20. The rotor assembly 12 includes an impeller 3 and a rotor 4. At least the rotor 4 includes a magnetic material, and the rotor 4 is of a cylinder shape. The impeller 3 is arranged at an end portion of the rotor 4, and is fixed to the rotor 4. The impeller 3 may include or may not include a magnetic material. The wet chamber 20 includes an impeller chamber 21 and a rotor chamber 22, and the impeller chamber 21 is in communication with the rotor chamber 22. The impeller 3 is arranged in the impeller chamber 21, the rotor 4 is arranged in the rotor chamber 22.

Figure 2:
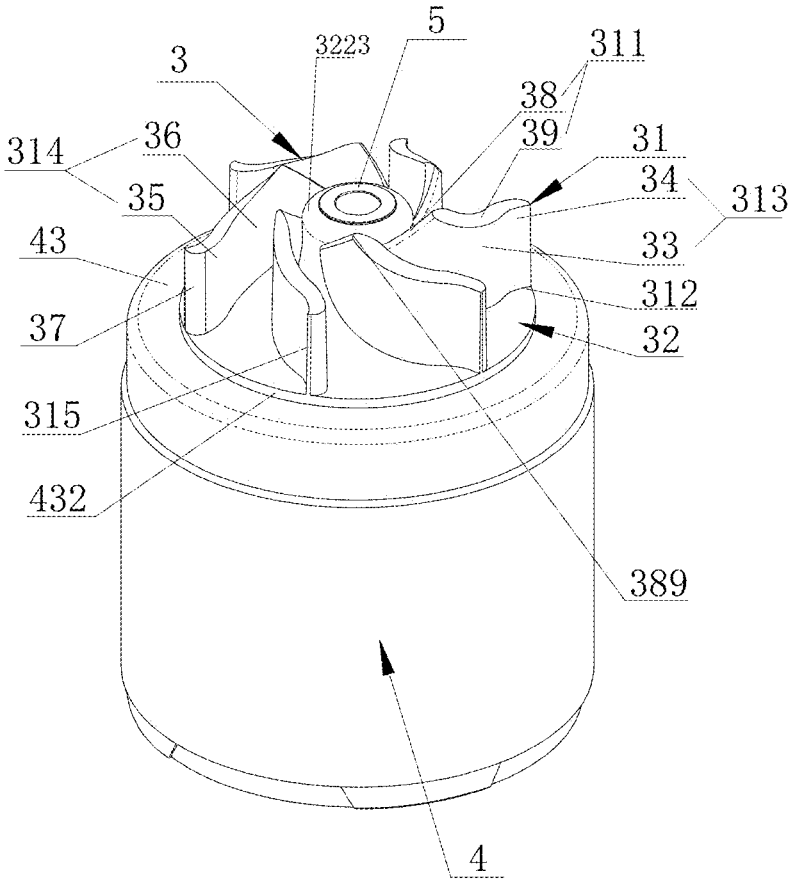
FIG. 2 is a perspective schematic view showing the structure of a rotor assembly 12 which includes an injection molded body and a shaft sleeve 5 in FIG. 1.

FIG. 2 is a perspective schematic view showing the structure of the rotor assembly 12, the rotor assembly 12 includes the impeller 3, the rotor 4 and the shaft sleeve 5. In this embodiment, the rotor 4 and the impeller 3 are integrally injection molded, and an injection molded body is formed by injection molding using the mixer of a magnetic material and a plastic material and taking the shaft sleeve 5 as an injection molding insert, or the injection molded body is formed by injection molding using a plastic material and taking the shaft sleeve 5 and a permanent magnet as the injection molding insert. The impeller 3 and the rotor 4 formed integrally by injection molding may have a reliable connection, a simple manufacturing process, and a relatively high consistency in one-step molding. Of course, the impeller 3 and the rotor 4 may also be separately formed, and are fixedly connected by a fixing device. The impeller 3 and the rotor 4 separately formed may adopt different materials, the impeller 3 may use a common plastic material, which can reduce the material cost. Also, in the case that the impeller 3 uses the plastic material rather than the magnetic material, a tenacity of the impeller 3 may be improved, and blades of the impeller 3 can be configured to be thin, and a hydraulic performance of the electrically driven pump may be improved. Thus the same rotors 4 may be matched with different impellers 3, and the different impellers 3 can change the hydraulic performance of the electrically driven pump 100. Various hydraulic performances may be achieved only by changing the impellers 3, thus the expense of molds for the rotor may be reduced. Furthermore, the cylindricity and a wall thickness uniformity of the rotor 4 separately injection molded are also easily ensured.

Reference is made to FIG. 2, the impeller 3 includes blades 31 and a blade fixing portion 32. The blades 31 and the blade fixing portion 32 are formed by injection molding. Multiple blades 31 are circumferentially arranged at equal intervals on an upper surface of the blade fixing portion 32, or multiple blades 31 are uniformly distributed on the upper surface of the blade fixing portion 32. For easily describing the blades, a central shaft of the impeller 3, two auxiliary planes, a first plane and an axial plane are introduced. The central shaft of the impeller 3 refers to a central shaft of the blade fixing portion 32, the first plane refers to a plane perpendicular to the central shaft of the impeller 3, and the axial plane refers to a plane passing through the central shaft of the impeller 3. The central shaft of the impeller 3 is substantially coaxial with a rotating shaft of the rotor assembly 12 or a rotating shaft of the impeller. Of course, a blade of other structures may also be arranged between the blades 31 in this technical solution, for example, a short blade with a length less than the length of the blade 31.

Figure 3:
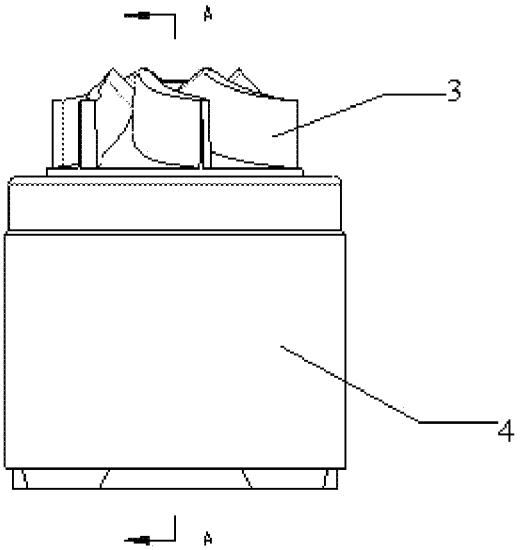
FIG. 3 is an orthographic view of the rotor assembly 12 in FIG. 2.
Figure 4:
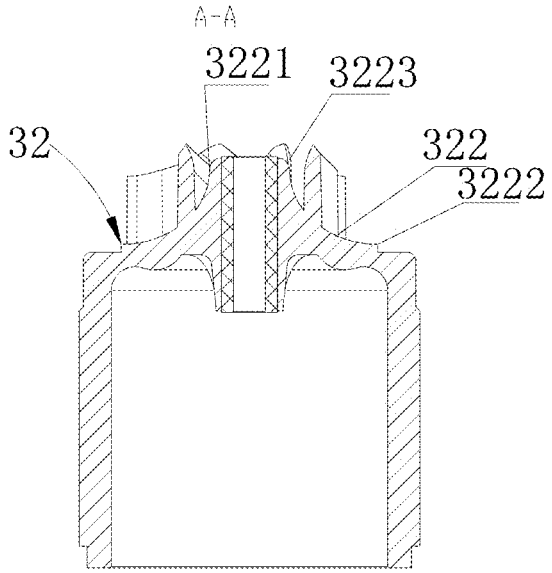
FIG. 4 is a sectional schematic view showing the structure of the rotor assembly 12 in FIG. 3 taken along line A-A.

Reference is made to FIGS. 3 and 4, the blade fixing portion 32 includes a camber portion 322 and a transition portion 3223, and the blade fixing portion 32 is of a structure similar to a hyperboloid having a slightly smaller upper portion and a slightly larger lower portion. The camber portion 322 includes an upper end 3221 and a lower end 3222. A tangential line of an outer surface of the upper end 3221 of the camber portion 322 is arranged substantially in parallel with a central shaft of the impeller 3, " substantially in parallel" here refers to that an angle formed between the tangential line of the outer surface of the upper end 3221 and the central shaft of the impeller 3 is less than or equal to 5 degrees. A tangential line, along a radial direction of the impeller 3, of the lower end 3222 of the camber portion 322 is arranged substantially perpendicularly to the central shaft of the impeller 3, " substantially perpendicularly" here means an angle formed between the tangential line, along the radial direction of the impeller 3, of the lower end 3222 of the camber portion 322 and the central shaft of the impeller 3 is greater than 85 degrees and less than 95 degrees. The upper end 3221 and the transition portion 3223 are smoothly transited, the camber portion 322 is of a structure formed by a curved line, which includes one circular arc or multiple combined circular arcs rotating along the central shaft of the impeller 3. Of course, the blade fixing portion 32 is not limited to the structure in this embodiment, the blade fixing portion 32 may be a plane or two inclined planes substantially perpendicular to each other. The shape of the blade fixing portion 32 is related to the position relationship between an upper end of the shaft, namely the end of the shaft corresponding to the upper end 3221, and the blade fixing portion 32. In the case that the upper end of the shaft is arranged above the upper surface of the blade fixing portion 32, the blade fixing portion 32 may include a camber or two inclined planes perpendicular to each other; and in the case that the upper end of the shaft is arranged below the upper surface of the blade fixing portion 32 or is level with the upper surface of the blade fixing portion 32, the blade fixing portion 32 is a plane.

Reference is made to FIG. 2, for easily marking reference numerals, the reference numerals are signed on multiple blades 32, and the structures of all blades 31 are the same. Each of the blades 31 includes a blade top portion 311, a blade root portion 312, a first side 313, a second side 314, and a connecting side 315. The blade root portion 312 and the blade fixing portion 32 are fixed by injection molding, the blade top portion 311 is a cantilever end of the blade 31, and the first side 313, the second side 314 and the connecting side 315 are located between the blade root portion 312 and the blade top portion 311. A circulating passage for the working medium is formed between a first side 313 of one blade 31 and a second side 314 of another blade adjacent to the blade 31 of the same impeller 3. The rotational direction of the impeller 3 is indicated by an arrow in FIG. 5. Specifically, the first side 313 is a pressure side, a second side 314 is a back pressure side, and generally, a pressure at the pressure side is greater than a pressure at the back pressure side.

Specifically, the first side 313 includes a first convex portion 33 and a first concave portion 34, and the first convex portion 33 and the first concave portion 34 are smoothly connected. The second side 314 includes a second convex portion 35 and a second concave portion 36, and the second convex portion 35 and the second concave portion 36 are smoothly connected. The blade 31 arranged in such a manner is of a concave-convex circular arc shape, which can balance a dynamic pressure and a static pressure of the centrifugal pump, and can also improve a hydraulic efficiency and a lift of the centrifugal pump in the case that the impeller 3 has a small external dimension. In this embodiment, the connection side 315 and the second concave portion 36 are transitionally connected via a camber 37, such an arrangement allows the working medium in the circulating passage between adjacent blades 31 to flow more smoothly at the back pressure side, thus reducing a frictional loss, and further improving the hydraulic efficiency of the centrifugal pump.

Figure 5:
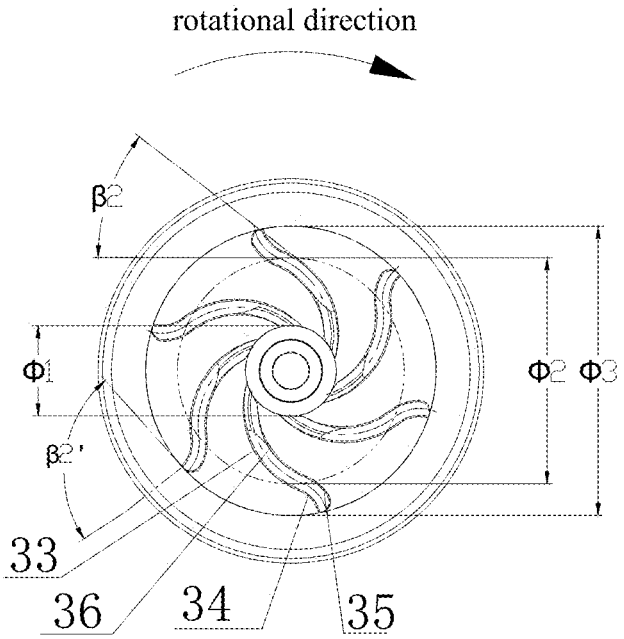
FIG. 5 is a top schematic view showing the structure of the rotor assembly 12 in FIG. 3.

Referring to FIG. 5, the camber portion 322 includes a hypothetical first circumference with a diameter being Φ1 defined by an outer surface of the upper end 3221, and the camber portion 322 includes a hypothetical third circumference with a diameter being Φ3 defined by the lower end 3222 of the camber portion 322. Or each of blades includes a beginning and a terminal, the hypothetical first circumference with a diameter being Φ1 is defined by the beginnings of the blades, the hypothetical third circumference with a diameter being Φ3 is defined by the terminals of the blades. Supposed that there is a hypothetical second circumference between the hypothetical first circumference and the hypothetical third circumference, and a diameter of the hypothetical second circumference is Φ2, where Φ1<Φ2<Φ3, the ratio of the diameter of the hypothetical second circumference to the diameter of the hypothetical third circumference, Φ2:Φ3, ranges from 0.75 to 0.9, and the ratio of the diameter of the hypothetical first circumference to the diameter of the hypothetical third circumference, Φ1:Φ3, ranges from 0.26 to 0.35. The first convex portion 33 starts from the hypothetical first circumference with the diameter of Φ1 of the blade fixing portion 32, and substantially terminates at the hypothetical second circumference with the diameter of Φ2 of the blade fixing portion 32. The first concave portion 34 starts from the hypothetical second circumference with the diameter of Φ2 of the blade fixing portion 32, and terminates at the hypothetical third circumference with the diameter of Φ3 of the blade fixing portion 32. An arc length of the first convex portion 33 and an arc length of the second concave portion 36 respectively refer to a length of, a circular arc starting from the hypothetical first circumference with the diameter of Φ1 of the blade fixing portion 32 and substantially ending at the hypothetical second circumference with the diameter of Φ2 of the blade fixing portion 32. The arc length of the first concave portion 34 and the arc length of the second convex portion 35 refer to lengths of circular arcs starting from the hypothetical second circumference with the diameter of Φ2 of the blade fixing portion 32 and ending at the hypothetical third circumference with the diameter of Φ3 of the blade fixing portion 32. The arc length of the first convex portion 33 is greater than the arc length of the first concave portion 34, and the arc length of the second concave portion 36 is greater than the arc length of the second convex portion 35. A blade angle of a first convex surface 33 is β32, and a blade angle of a second convex surface 35 is β2', β2 and β2' satisfy the relationship: 20 degrees<β2<β2'<90 degrees. The blade angle β2 refers to an included angle between a tangential line of the hypothetical second circumference and a tangential line of the first convex portion 33 at an intersection of the hypothetical second circumference with the diameter of Φ2 and the blade. The blade angle β2' refers to an included angle between a tangential line of the hypothetical third circumference and a tangential line of the first concave portion 34 at an intersecting point of the hypothetical third circumference with the diameter of Φ3 and the blade. Generally, with the same target lift, since a disk friction loss is in a direct proportion to the fifth power of an outer diameter of the impeller, the greater the blade angle β2 of the blade 31 is, the smaller the outer diameter of the impeller may be, and the friction loss may be reduced to a certain degree, thereby improving the hydraulic efficiency of the pump. In addition, if the outer diameter of the impeller 3 keeps unchanged, when the blade angle β2 of the blade 31 is appropriately increased, the lift of the centrifugal pump can be improved.

However, the blade angle β2 cannot be limitlessly increased, and an exceedingly increased blade angle β2 may cause the relative flow of the working medium between adjacent blades 31 to be seriously diffused, and also cause an impact loss under the condition of a small flow rate to be increased, and is apt to cause a lift and flow rate relationship curve of the centrifugal pump to generate hump and generate instable performance curve. For acquiring a stable performance curve and preventing the overload, aiming at the impeller structure according to the present application, the blade angle according to the present application is set to within a range of 20 degree<β2<β2'<90 degrees, and the pump having the blade angles within this range may obtain a good performance curve.

The blade top portion 311 includes a proximal portion 38 and a distal portion 39. The proximal portion 38 is arranged to be closer to the center shaft of the impeller 3 than the distal portion 39, and a thickness of the proximal portion 38 is less than a thickness of the distal portion 39. Such an arrangement can increase a cross sectional area of an inlet of the circulating passage formed between adjacent blades, to allow the working medium to smoothly enter into the circulating passage at the proximal portion. A joint 389 between the proximal portion 38 and the distal portion 39 is a highest point of the blade top portion 311, and a height of the highest point at the joint 389 between the proximal portion 38 and the distal portion 39 is greater than a height of the connection side 315. The height of the proximal portion 38 gradually increases from one end close to the central shaft of the impeller 3 to the joint 389 between the proximal portion 38 and the distal portion 39, and the smallest height of the proximal portion 38 is less than or equal to the largest height of the blade fixing portion 32. The height of the distal portion 39 gradually increases from one end where the connection side is located to the joint 389 between the proximal portion 38 and the distal portion 39.

Figure 6:
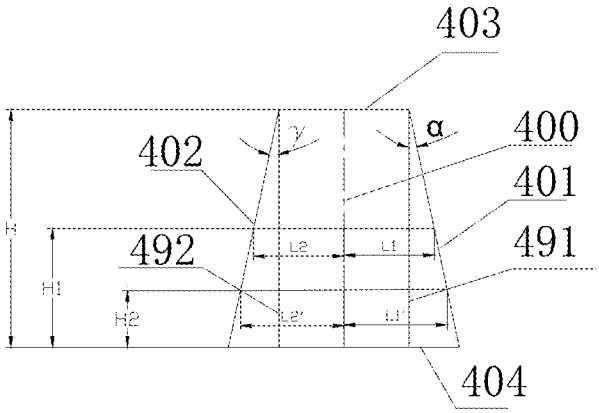
FIG. 6 is a schematic view of a blade cross section of the rotor assembly 12 in FIG. 2 according to a first embodiment of the present application.
Figure 7:
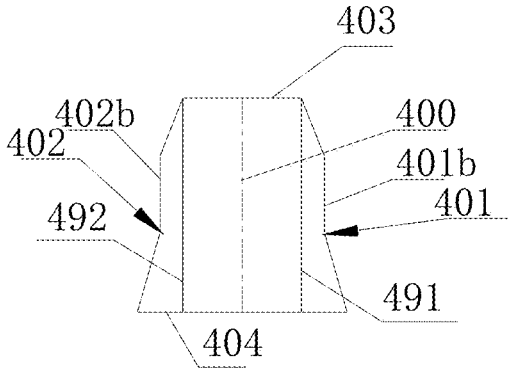
FIG. 7 is a schematic view of the blade cross section of the rotor assembly 12 in FIG. 2 according to a second embodiment of the present application.
Figure 8:
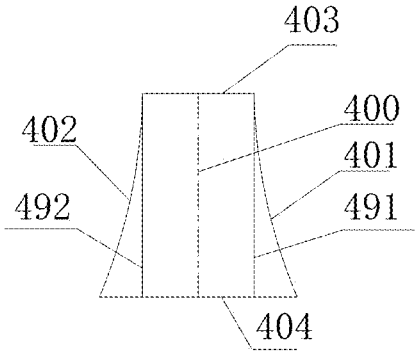
FIG. 8 is a schematic view of the blade cross section of the rotor assembly 12 in FIG. 2 according to a third embodiment of the present application.

The blade root portion 312 and the blade fixing portion 32 are fixed by injection molding, the blade 31 is a cylindrical blade, and the blade 31 is arranged substantially perpendicularly to the first plane. The blade 31 being arranged perpendicularly to the first plane refers to that a symmetry plane of the first side 313 and the second side 314 of the blade 31 is arranged perpendicularly to the first plane. The first side 313 and the second side 314 are each arranged to form a certain included angle with respect to the symmetry plane. For facilitating the demolding process after the injection molding of the blades, the included angle approximately ranges from 0.9 degree to 2.5 degrees, and the included angle may be 1 degree according to the manufacturing requirements. A blade cross section 40 is defined by hypothetically cutting the blade 31 with an outer surface of a hypothetical cylinder taking a central shaft of the impeller 3 as an axis, and the blade cross section 40 is arranged perpendicularly to the first plane. The blade cross section 40 includes a first intersecting line 401, a second intersecting line 402, a third intersecting line 403, a fourth intersecting line 404 and a middle line 400. The first intersecting line 401 is an intersecting line between the surface of the hypothetical cylinder and the first side 313 of the blade, and the first intersecting line 401 may be one straight line segment, multiple straight line segments, or one circular arc, or multiple circular arcs depending on the shape of the first side 313. The second intersecting line 402 is an intersecting line between the outer surface of the hypothetical cylinder and the second side 314, and the second intersecting line 402 may be one straight line segment, multiple straight line segments, or one circular arc, or multiple circular arcs depending on the shape of the second side 314. The third intersecting line 403 is an intersecting line between the outer surface of the hypothetical cylinder and the blade top portion 311, and the third intersecting line 403 is actually a circular arc, however, since the blade top portion 311 is thin, the third intersecting line 403 is approximately shown as a straight line segment. The fourth intersecting line 404 is an intersecting line between the outer surface of the hypothetical cylinder and the blade root portion 312, and the fourth intersecting line 404 is actually a circular arc, however, since the blade root portion 312 is thin, the fourth intersecting line 404 is approximately shown as a straight line segment. The middle line 400 is a straight line passing through a middle point of the third intersecting line 403 and parallel to the central shaft of the impeller 3, since the third intersecting line 403 is the circular arc, a middle point of a connection line connecting two ends of the third intersecting line 403 is taken as the middle point of the third intersecting line 403. FIG. 6 shows a first embodiment of the blade cross section 40. In this embodiment, the shape of the blade cross section 40 is substantially an isosceles trapezoid, i.e., the first intersecting line 401 and the second intersecting line 402 are each a straight line segment. The intersecting lines defined by the first side 313 and the second side 314 intersecting with the outer surface of the hypothetical cylinder are respectively the first intersecting line 401 and the second intersecting line 402, the intersecting line defined by the blade top portion 311 intersecting with the outer surface of the hypothetical cylinder is the third intersecting line 403, and the intersecting line defined by the blade root portion 312 intersecting with the outer surface of the hypothetical cylinder is the fourth intersecting line 404. Since the blade 31 is thin, the third intersecting line 403 and the fourth intersecting line 404 are short, and may be approximately regarded as straight line segments. The first intersecting line 401 and the second intersecting line 402 are symmetric with respect to the middle line 400 of the blade cross section 400, and the third intersecting line 403 and the fourth intersecting line 404 are both arranged to be perpendicular to the middle line 400, and the third intersecting line 403 and the fourth intersecting line 404 are arranged to be substantially parallel to each other. A first included angle $\alpha$ defined between the first intersecting line 401 and a first parallel line 491 parallel to the central shaft of the impeller 3 is substantially equal to a second included angle $\gamma$ between the second intersecting line 402 and a second parallel line 492 parallel to the central shaft of the impeller 3. The first included angle $\alpha$ and the second included angle $\gamma$ are each generally referred to as included angle, and the included angle approximately ranges from 0.9 degree to 2.5 degrees. A height H of the blade 31 refers to a distance from the third intersecting line 403 to the fourth intersecting line 404 in the blade cross section 40. In the blade cross section 40, at a portion with a blade height being a first height H1, a distance between the first intersecting line 401 and the middle line 400 is a first distance L1, and a distance between the second intersecting line 402 and the middle line 400 is a second distance L2. And at a portion with a blade height being a second height H2, a distance between the first intersecting line 401 and the middle line 400 is a third distance L3, and a distance between the second intersecting line 402 and the middle line 400 is a fourth distance L2'. Thus, the following relationship is satisfied: in the case that a distance from the portion with the first height H1 to blade root portion is more than a distance from the portion with the second height H2, i.e., a length of the first height H1 is greater than a length of the second height H2, the first distance L1 is less than or equal to the third distance L1', and the second distance L2 is less than or equal to the fourth distance L2'. A thickness of the distal portion 39 ranges from 1.4 mm to 1.6 mm. Thus strength of the blades may be ensured, and also since the blades are made by a injection mould process, the demolding manufacturability may be improved when the included angle exists. Of course, the first intersecting line 401 and the second intersecting line 402 may also be multiple line segments (as shown in FIG. 7), or one circular arc, or multiple circular arcs (as shown in FIG. 8), as long as the following conditions can be satisfied: the first intersecting line 401 and the second intersecting line 402 are arranged to be substantially symmetric with respect to the middle line 400 of the blade cross section 40, and the first intersecting line 401 and the second intersecting line 402 are located outside an area encircled by the first parallel line 491, the second parallel line 492, the third intersecting line 403 and the fourth intersecting line 404. Also in a direction from the third intersecting line 403 to the fourth intersecting line 404, a distance from the first intersecting line 401 to the middle line 400 and a distance from the second intersecting line 402 to the middle line 400 are progressively increased, and may be kept constant at a certain part, such a case is also included, as shown in FIG. 7, a distance from a segment 401*b* of the first intersecting line 401 to the middle line 400 is constant, and the distance from the segment 402*b* of the second intersecting line 402 to the middle line 400 is constant.

According to the general principle in hydraulic design of the centrifugal pump, increasing the number of blades 31 can improve a restraining capability of the impeller 3 to the working medium, and facilitate the improvement of the hydraulic efficiency. However, increasing the number of the blades 31 may also cause the circulating passage between adjacent blades 31 for the working medium to become narrow, especially may cause the cross section of the inlet of circulating passage to be reduced, thus reducing the hydraulic efficiency, and even causing cavitation. Also in the case that the impeller 3 and the rotor 4 are designed to be integrally injection molded, the material of the integral injection molded blade contains the magnetic material, which generally has a high brittleness, with a small thickness, the blade is apt to be broken, fractured or damaged, therefore the blade cannot be too thin. It should not only be ensured that the cross section of the circulating passage cannot be to small, but also should be ensured that the thickness of the blade cannot be too large, and the number of the blades cannot be too large. The impeller 3 may include four to eight blades 31, and according to the result of hydraulic testing, the impeller 3 including an even number of blades facilitates the dynamic balance during rotation of the rotor. The number of the blades in this embodiment is six, which can not only ensure the dynamic balance, but also allows the dimension of the flow passage and the restraining of the impeller to the working medium to reach a better state according to the dimension requirements of the outer diameter of the impeller and the hypothetical first circumference.

Figure 9:
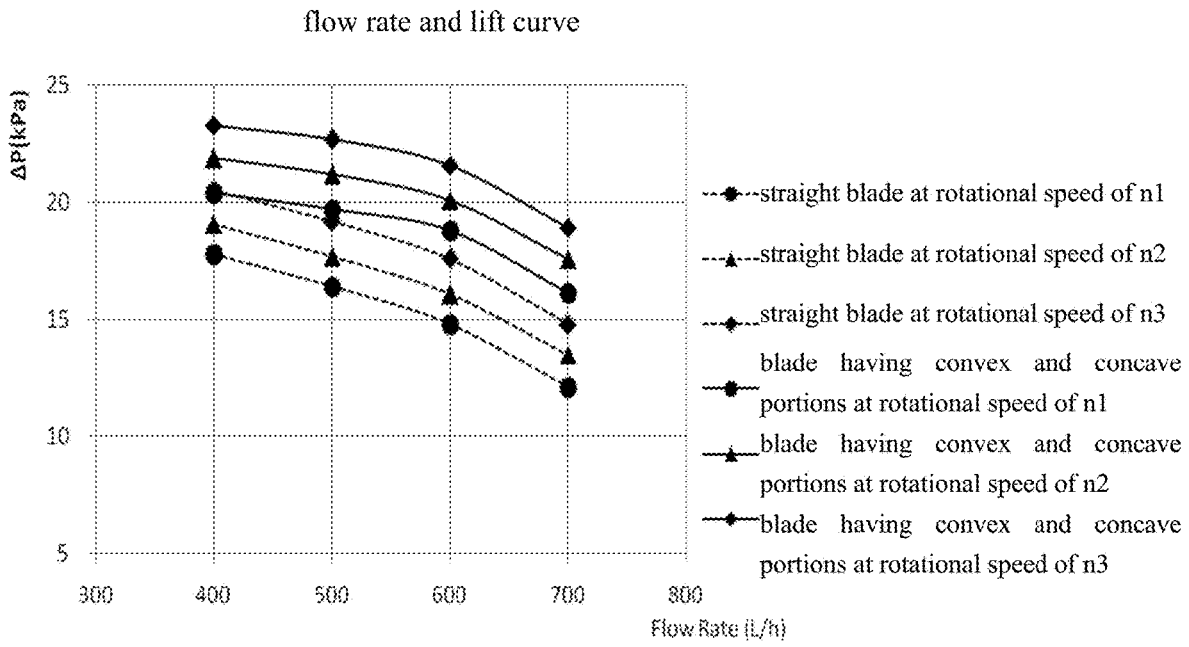
FIG. 9 is a comparison diagram showing lift trends of an electrically driven pump having an impeller with straight blades and an electrically driven pump having an impeller with blades according to the present application at certain rotational speeds and flow rates.

FIG. 9 is a comparison diagram showing lift trends of an electrically driven pump having an impeller with straight blades, and an electrically driven pump having an impeller with blades having a convex portion and a concave portion, at three rotational speeds and specific flow rates. The solid lines in the drawing represent the lift trends of the electrically driven pump having blades with the convex portion and the concave portion, and the dotted lines represent the lift trends of the electrically driven pump having the straight blades. The rotational speed corresponding to a curved line having circular nodes is n1, the rotational speed corresponding to a curved line having triangular nodes is n2, and the rotational speed corresponding to a curved line having rhombus nodes is n3. It may be concluded from the drawing that, at the same rotational speed and the same flow rate, the lift to which the impeller having blades with the convex portion and the concave portion corresponds is greater than the lift to which the impeller having straight blades corresponds.

Figure 10:
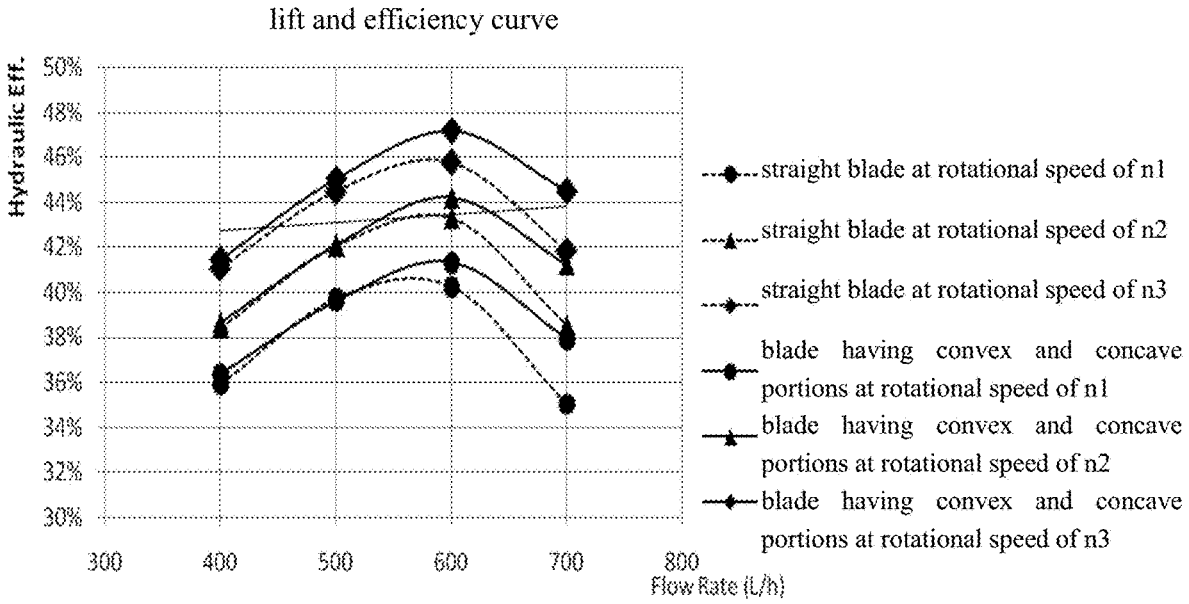
FIG. 10 is a comparison diagram showing hydraulic efficiencies of an electrically driven pump having an impeller with straight blades and an electrically driven pump having an impeller with blades according to the present application at certain rotational speeds and flow rates.

FIG. 10 is a comparison diagram showing hydraulic efficiencies trends of an electrically driven pump having an impeller with straight blades, and an electrically driven pump having an impeller with blades which have a convex portion and a concave portion, at three rotational speeds and specific flow rates. The solid lines in the drawing represent the hydraulic efficiencies trends of the electrically driven pump having blades with the convex portion and the concave portion, and the dotted lines represent the hydraulic efficiencies trends of the electrically driven pump having straight blades. The rotational speed corresponding to a curved line having circular nodes is n1, the rotational speed corresponding to a curved line having triangular nodes is n2, and the rotational speed corresponding to a curved line having rhombus nodes is n3. It may be seen from the drawing that, at the same rotational speed and the same flow rate, the efficiency to which the impeller having blades with the convex portion and the concave portion corresponds is greater than the efficiency to which the impeller having straight blades corresponds.

Reference is made to FIGS. 1 and 2, in this embodiment, the rotor assembly 12 includes an impeller 3 and a rotor 4. The rotor 4 includes a magnetic material, and the rotor 4 and the impeller 3 are integrally injection molded. An outer diameter of the rotor 4 is greater than an outer diameter of the impeller 3, and a connecting portion 43 with a certain distance is provided between the outer diameter of the impeller 3 and the outer surface of the rotor 4. A stepped portion 432 is formed between the connecting portion 43 and the blade fixing portion 32 of the impeller 3. Thus, in the case that the rotor assembly 12 moves in the flow chamber 20, a friction between the rotor assembly 12 and the pump cover 11 may be prevented and the mechanical loss may be reduced, which may improve the efficiency of the electrically driven pump.

A method for manufacturing a centrifugal pump is further provided according to the present application, the centrifugal pump includes a rotor assembly 12, the rotor assembly includes an injection molded body and a shaft sleeve, the injection molded body includes an impeller, and the impeller includes blades and a blade fixing portion. The manufacturing of the rotor assembly 12 includes the following steps.

In step 1, fixing the shaft sleeve to a rotor assembly mould. The rotor assembly mould is configured to form the injection molded body of the rotor assembly, and the shaft sleeve includes a shaft sleeve inner cavity, the rotor assembly mould forms an molded cavity, a fixing shaft is fixed in the molded cavity. The step of fixing the shaft sleeve to the rotor assembly mould includes: sleeving the shaft sleeve on the fixing shaft.

In step 2, forming the injection molded body of the rotor assembly by injection molding, including: injection molding a filled material into the molded cavity of the rotor assembly mould, ensuring that the mixed material is filled into the inner cavity of the mould, and cooling and solidifying the injection molded body of the rotor assembly.

In step 3, demolding, including: stripping a combined the injection molded body and the shaft sleeve from the rotor assembly mould. The injection molded body includes an impeller, the impeller includes blades and a blade fixing portion, the blades and the blade fixing portion are fixed by injection molding. Each of the blades includes a first side, a second side, a connection side and a blade top portion, and the first side and the second side are connected by the connection side and the blade top portion. The first side includes a first convex portion and a first concave portion, the first convex portion and the first concave portion are connected smoothly, the second side includes a second convex portion and a second concave portion, and the second convex portion and the second concave portion are connected smoothly. An outer surface of a hypothetical cylinder taking a central shaft of the impeller as an axis hypothetically cuts the blade to form a blade cross section, and a plane perpendicular to the central shaft of the impeller is arranged to be perpendicular to the blade cross section; the blade cross section includes a first intersecting line, a second intersecting line, a third intersecting line and a middle line, the first intersecting line is an intersecting line defined by the outer surface of the hypothetical cylinder intersecting with the first side, the second intersecting line is an intersecting line defined by the hypothetical cylinder surface intersecting with the second side, the third intersecting line is an intersecting line defined by the outer surface of the hypothetical cylinder intersecting with the blade top portion, and the middle line is a straight line passing through a middle point of the third intersecting line and parallel to the central shaft of the impeller. A height of the blade in the blade cross section is defined as a distance from the fourth intersecting line to an intersection between, the first intersecting line or the second intersecting line, and a line parallel to the fourth intersecting line, in the blade cross section at a portion with a first height H1, a distance from the first intersecting line to the middle line is a first distance L1, and a distance from the second intersecting line to the middle line is a second distance L2, and at a portion with a second height H2, a distance from the first intersecting line to the middle line is a third distance L1', and a distance from the second intersecting line to the middle line is a fourth distance L2', the following relationship is satisfied: in the case that the first height H1 is greater than the second height H2, the first distance L1 is less than or equal to the third distance L1', and the second distance L2 is less than or equal to the fourth distance L2'.

In step 2, at least two injection gates of the rotor assembly mould are included, the injection gates are respectively arranged at an upper surface, between adjacent blades, of the blade fixing portion of the impeller, and the injection gates are uniformly distributed at the blade fixing portion, being uniformly distribution means that the injection gates are symmetrically distributed on the blade fixing portion. With such an arrangement, the rotor assembly injection molded is uniform.

The manufacturing process of the centrifugal pump further includes forming of the shaft sleeve. The shaft sleeve is injected molded through a shaft sleeve mould, the shaft sleeve injection molded is substantially of a cylindrical shape, which includes a shaft sleeve inner surface and a shaft sleeve outer surface.

During the demolding in step 3, the rotor assembly mould is provided with ejector structures, and the ejector structures are uniformly distributed at intervals along the circumference of the rotor. Since an injection molded body of the rotor assembly is of a bell shape, adopting of the ejector structures facilitates the demolding operation.

In the case that the rotor assembly mould has multiple mould cavities, each mould cavity is provided therein with a code number, which facilitates treatment of the corresponding products and mould maintenance of the mould for injection molding the corresponding products.

It is to be noted that, the above embodiments are only intended for describing the present application, and should not be interpreted as limitation to the technical solutions of the present application. Although the present application is described in detail in conjunction with the above embodiments, it should be understood by those skilled in the art that, modifications or equivalent substitutions may still be made to the present application by those skilled in the art; and any technical solutions and improvements thereof without departing from the spirit and scope of the present application should all fall into the scope of the present application defined by the claims.

The invention claimed is:

1. A centrifugal pump, comprising a rotor assembly and a shaft, wherein the rotor assembly is rotatable about the shaft or rotatable together with the shaft, the rotor assembly comprises an impeller, and the impeller is rotatable about the shaft or rotatable together with the shaft, wherein the impeller comprises blades and a blade fixing portion, the blades are uniformly distributed in a circumferential direction of the blade fixing portion, the impeller defines a hypothetical cylinder surface taking a central shaft of the blade fixing portion as a center line, intersections defined by the blades intersecting with the hypothetical cylinder surface are distributed at equal intervals in a circumferential direction of the hypothetical cylinder surface;

each of the blades comprises a first side, a second side, a blade top portion and a blade root portion, the blade root portion and the blade fixing portion are formed by injection molding or fixed by injection molding, the blade top portion is a free end of each of the blades, the first side and the second side are located between the blade root portion and the blade top portion, each of the first side and the second side comprises a convex portion and a concave portion, and the convex portion and the concave portion are smoothly connected;

a blade cross section is defined by cutting each of the blades via the hypothetical cylinder surface, the blade cross section comprises a first intersecting line, a second intersecting line, a third intersecting line and a fourth intersecting line, wherein the first intersecting line is an intersecting line defined by the hypothetical cylinder surface intersecting with the first side, the second intersecting line is an intersecting line defined by the hypothetical cylinder surface intersecting with the second side, the third intersecting line is an intersecting line defined by the hypothetical cylinder surface intersecting with the blade top portion, and the fourth intersecting line is an intersecting line defined by the hypothetical cylinder surface intersecting with the blade root portion, and a middle line is a straight line passing through a middle point of the third intersecting line and parallel to the central shaft of the impeller; and a height of the blade in the blade cross section is defined as a distance from the fourth intersecting line to, an intersection between, the first intersecting line or the second intersecting line, and a line parallel to the fourth intersecting line, in the blade cross section at a portion with a first height (H1), a distance from the first intersecting line to the middle line is a first distance (L1), and a distance from the second intersecting line to the middle line is a second distance (L2), and at a portion with a second height (H2), a distance from the first intersecting line to the middle line is a third distance (L1'), and a distance from the second intersecting line to the middle line is a fourth distance (L2'), the following relationship is satisfied: in the case that the first height (H1) is greater than the second height (H2), the first distance (L1) is less than or equal to the third distance (L1'), and the second distance (L2) is less than or equal to the fourth distance (L2'), wherein a hypothetical first circumference with a diameter of Φ1 is defined by beginnings of the blades towards to the central shaft of the impeller, a hypothetical third circumference with a diameter of Φ3 is defined by terminals of the blades, and there is a hypothetical second circumference with a diameter of Φ2 between the hypothetical first circumference and the hypothetical third circumference, wherein Φ1<Φ2<101 3, and the ratio of the diameter of the hypothetical second circumference to the diameter of the hypothetical third circumference, Φ2:Φ3, ranges from 0.75 to 0.9;

the first convex portion of the first side and the second concave portion of the second side both start from the hypothetical first circumference and end at the hypothetical second circumference, or the first concave portion of the first side and the second convex portion of the second side start from the hypothetical second circumference and end at the hypothetical third circumference, wherein at an intersection between the first convex portion and the hypothetical second circumference, an included angle between a tangential line of the first convex portion and a tangential line of the hypothetical second circumference is a blade angle β2;

at an intersecting point between the first concave portion and the hypothetical third circumference, an included angle between a tangential line of the first concave portion and a tangential line of the hypothetical third circumference is a blade angle β2';

wherein the blade angle β2and the blade angle β2' meet the following relationship: 20 degrees<β2<β2'<90 degrees, wherein the rotor assembly comprises a rotor containing a magnetic material and configured to drive the impeller to rotate, the centrifugal pump comprises a stator assembly, and the rotor and the stator assembly interact with each other via a magnetic field force; and the centrifugal pump further comprises a shaft sleeve, the rotor and the impeller are integrally formed by injection molding taking the shaft sleeve as an insert, the rotor is of a cylindrical shape, the impeller is arranged above the rotor, an outer diameter of the rotor is greater than an outer diameter of the impeller, and a connecting portion is provided between the outer diameter of the impeller and the outer surface of the rotor and stepped portion is provided between the blade fixing portion and a connecting portion, the stepped portion is of a circular shape, and an outer end of each blade is located at the circumference of the stepped portion.

2. The centrifugal pump according to claim 1, wherein the first side comprises a first convex portion and a first concave portion, the first convex portion is closer to the central shaft of the impeller than the first concave portion, a hypothetical perpendicular plane perpendicular to the central shaft of the impeller is defined, each of the blades projects an image into the hypothetical perpendicular plane, and in the perpendicular plane, a length of the first convex portion is greater than a length of the first concave portion; and the second side comprises a second convex portion and a second concave portion, the second concave portion is closer to the central shaft of the impeller than the second convex portion, and in the perpendicular plane, a length of the second concave portion is greater than a length of the second convex portion.

3. The centrifugal pump according to claim 2, wherein each of the blades further comprises a connection side, the first side and the second side are connected by the connection side, the connection side is parallel to the central shaft of the impeller and is arranged towards to an outer edge of the blade fixing portion, and the second convex portion of the second side and the connection side are connected via an arc surface and form a smooth transition.

4. The centrifugal pump according to claim 1, wherein the blade top portion comprises a proximal portion and a distal portion, the proximal portion is closer to the central shaft of the impeller than the distal portion, a thickness of the proximal portion is less than a thickness of the distal portion, and an end of the proximal portion and the blade fixing portion are formed by injection molding or fixed by injection molding.

5. The centrifugal pump according to claim 4, wherein a point between the proximal portion and the distal portion is a highest point of the blade top portion from the blade fixing portion, a height of the proximal portion is increased from one end towards to the central shaft of the impeller to the point, and a height of the distal portion is increased from one end where the connection side is located, to the point.

6. The centrifugal pump according to claim 1, wherein the ratio of the diameter Φ1 of the hypothetical first circumference to the diameter Φ3 of the hypothetical third circumference, Φ1:Φ3, ranges from 0.26 to 0.35.

7. The centrifugal pump according to claim 1, wherein in the blade cross section, the first intersecting line and the second intersecting line are arranged symmetric respect to the middle line, each of the first intersecting line and the second intersecting line is a straight line segment, an included angle is defined between the first intersecting line and a parallel line of the middle line, an included angle is defined between the second intersecting line and a parallel line of the middle line, and each of the included angles ranges from 1 degree to 2.5 degrees.

* * * * *